US006579411B1

(12) United States Patent
Henricson et al.

(10) Patent No.: US 6,579,411 B1
(45) Date of Patent: Jun. 17, 2003

(54) BLEACHING MEDIUM CONSISTENCY PULP WITH OZONE

(75) Inventors: Kaj Henricson, Kotka (FI); Torolf Laxen, Helsingfors (FI); Juhani Peltonen, Imatra (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 08/462,691

(22) Filed: Jun. 5, 1995

Related U.S. Application Data

(62) Division of application No. 07/808,986, filed on Dec. 17, 1991, now abandoned, which is a continuation of application No. 07/498,205, filed on Mar. 23, 1990, now abandoned.

(30) Foreign Application Priority Data

May 10, 1989 (FR) ..... 89 2243

(51) Int. Cl.[7] ..... D21C 9/153
(52) U.S. Cl. ..... 162/57; 162/65
(58) Field of Search ..... 162/65, 57

(56) References Cited

U.S. PATENT DOCUMENTS 4,080,249 A * 3/1978 Kempf et al. ..... 162/65
4,119,486 A * 10/1978 Eckert ..... 162/65
4,902,381 A * 2/1990 Meredith et al. ..... 162/65

FOREIGN PATENT DOCUMENTS

| | | | |
|---|---|---|---|
| CA | 1 065 105 | * 10/1979 | ..... 162/65 |
| CA | 1 103 409 | * 6/1981 | ..... 162/65 |
| FR | 2 620 744 | * 3/1989 | ..... 162/65 |
| JP | 54-30902 | * 3/1979 | ..... 162/65 |
| WO | WO 83/00816 | 3/1983 | |

OTHER PUBLICATIONS

Singh, "Ozone Replaces Chlorine In the First Bleaching Stage", TAPPI, vol. 65, No. 2; Feb. 1982.*
Reeve et al, "Studies with a High–Intensity Medium Consistency Laboratory Pulp Mixer", 1985, pp. 19–23.*
Soteland, "The Effect of Ozone on Mechanical Pulps", Norsk Skogindustri, Jun. 1974, pp. 165–169.*

* cited by examiner

*Primary Examiner*—Steve Alvo
(74) *Attorney, Agent, or Firm*—Nixon & Vanderhye P.C.

(57) ABSTRACT

A method of bleaching cellulose pulp with ozone includes pumping cellulose pulp in form of a fiber suspension having a consistency range of 5 to 25% with a high-consistency pump to a fluidizing Mixture in which oxygen and ozone containing gas is introduced and mixed into the pulp so as to generate a foam whereby the pulp fibers and the ozone used as the bleaching agent are brought to contact with each other, bleached, and the pulp is discharged from the mixer to a reaction vessel.

18 Claims, 2 Drawing Sheets

BLEACHING MEDIUM CONSISTENCY PULP WITH OZONE

This is a divsional of application Ser. No. 07/808,986, filed Dec. 17, 1991, now abandoned which was in turn a continuation of application Ser. No. 07/498,205, filed Mar. 23, 1990 now abandoned.

FIELD OF THE INVENTION

The present invention relates to a method of bleaching cellulose pulp with ozone, and specifically to a method of bleaching pulp with ozone in a foam-like mixture.

BACKGROUND OF THE INVENTION

Pulp for the paper and pulp industry must often be bleached in order to produce an end product of suitable high-quality. The most commonly used bleaching agents today are chlorine and oxygen. There is a tendency to avoid the use of chlorine or at least limit its use to a minimum because of damage caused thereby to the environment. Oxygen is a suitable bleaching agent but its reaction selectivity is not always adequate so that other additional chemicals must be used. For these reasons, new bleaching agents have been sought. Ozone is one of them.

Ozone bleaching has been extensively studied in laboratory and pilot scale. Ozone has proved to be a satisfactory bleaching agent but also expensive and difficult to use as the consistency of the pulp to be bleached has to be very low or very high due to the high reactivity of the ozone. For example, at low consistencies, i.e. below 5%, ozone is dissolved in the water and thus satisfactory transfer of mass between the ozone and the fibers in the water is achieved as the ozone containing water can freely flow between the fibers. It has also been found out that ozone, being a gaseous substance, reacts well directly with a dry fiber surface which presupposes that the consistency is so high, in most cases over 30%, that there is practically no water on the surface of the fiber or between the fibers. In these circumstances the ozone containing gas can freely flow between the fibers.

On the other hand, to assure proper pumpability of the suspension, a certain amount of free water in the suspension must be present. For environmental and other reasons, it is desirable to keep this amount of water as small as possible. Accordingly, these factors define the consistency range which is optimal for both the apparatus and the environment and which lies between about 5 and about 25%. However, in this particular consistency range ozone cannot contact the fibers in a satisfactory way as there is relatively little liquid in the suspension which is bound in the spaces between the fibers and does not move freely in the suspension, and as ozone, being a gaseous substance, cannot, due to the state of the suspension, move freely within the fiber suspension.

SUMMARY OF THE INVENTION

The aforesaid problems have been solved by providing a method for bleaching pulp with ozone at a consistency range of about 5 to about 25%. According to the invention, conditions for good mass transfer are created even under conditions in which gas or water cannot move freely throughout the fiber suspension. Hence, the present invention provides bleaching the fiber suspension in the form of a foam-like mixture. Preferably, the fibers are pumped with a medium consistency pump (MC pump) to a fluidizing mixer, in the mixer oxygen and ozone containing gas is mixed into the pulp, contacting the ozone gas which serves as the bleaching agent with the fibers of the pulp by mixing the gas into the pulp, and discharging the fiber suspension from the mixer, preferably, into a reaction vessel.

In a preferred embodiment, the bleaching process is performed in at least two steps and residual gas is removed after the first step or stage preferably in a reaction vessel. Prior to the second stage, additional oxygen and ozone containing gas is added to a second mixer provided downstream of the first mixer and reaction vessel.

BRIEF DESCRIPTION OF THE DRAWING

The invention is described below in detail with reference to the accompanying drawing figures in which.

DETAILED DESCRIPTION OF THE PRESENTLY PREFERRED EMBODIMENT

Figure 1:
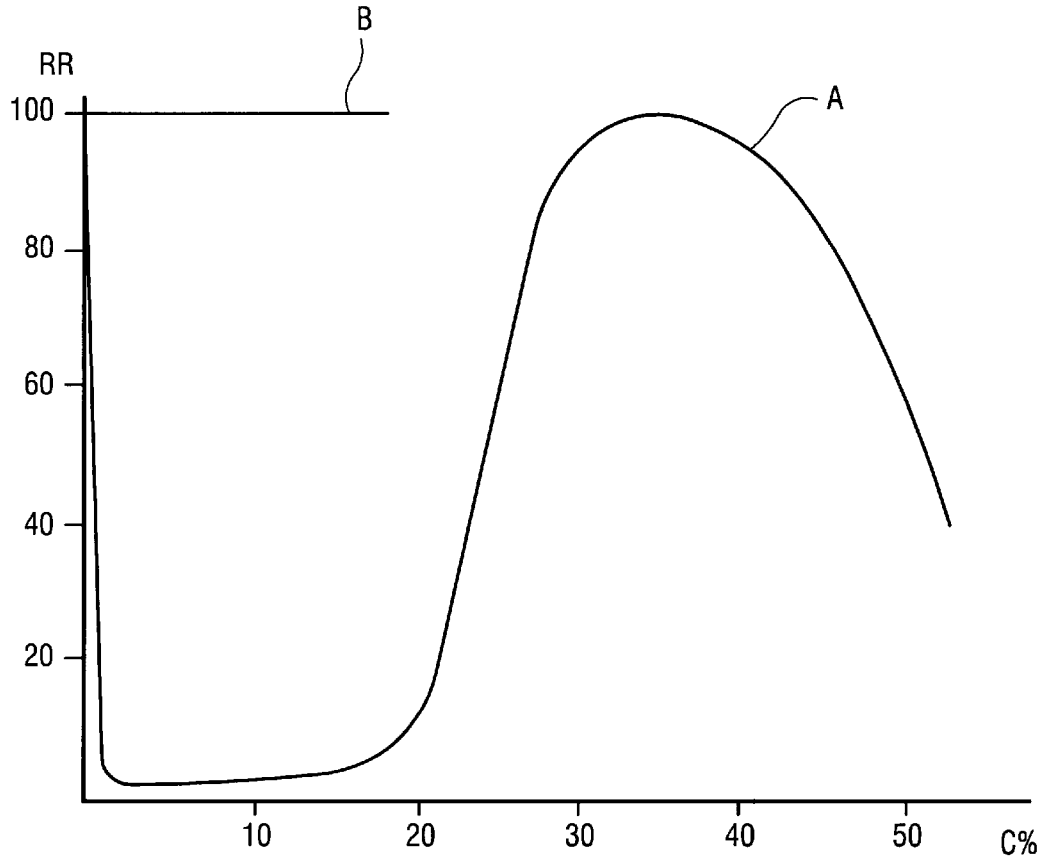
FIG. 1 illustrates a comparison of a state of the art ozone bleaching method and the ozone bleaching method of the present invention.

FIG. 1 illustrates, as a function of pulp consistency, comparative reaction results of a conventional ozone bleaching process and the ozone bleaching process applying the method of the present invention. In FIG. 1, curve A illustrates a typical result from ozone bleaching with a state of the art method. Curve B illustrates the result achieved by ozone bleaching with the method of the present invention. By conventional methods at low consistencies (0 to 3%) ozone dissolves in water and when the pulp-water mixture is agitated, good transfer of substance between the ozone and the fibers is achieved. Thus bleaching is effective in a diluted pulp suspension. At high consistencies (over 25%) ozone bleaching is carried out mostly as gas phase bleaching. Ozone in gaseous form reacts well with a fiber surface whereby good transfer of substance is gained between the ozone and the fibers. Gas moves freely between the fibers and bleaching proceeds well. At the consistency range of about 5 to about 25%, however, good ozone bleaching requires special measures. The reason of the poor reaction is the somewhat solid nature of the pulp suspension at these consistencies. Water and air cannot readily move in the half-solid pulp. As illustrated in FIG. 1, curve B, the same bleaching result as with conventional bleaching is achieved only at low and high consistencies (below about 5% and above about 20%).

A characteristic feature of the method of the invention is that in a pulp suspension having the consistency of about 5 to about 25%, conditions are created where ozone can sufficiently contact the fibers. The simplest way of doing this has proved to be the mixing of ozone gas into the fiber suspension with an intensive high-shear mixer so as to generated foam consisting of wood fibers, water and $O_2/O_3$ gas. The intense agitation required by the method can be generated by e.g. a fluidizing mixer disclosed in Finnish patent application No. 870,747 assigned to A. Ahlstrom Corporation. This mixer typically brings so much mixing efficiency to a small space that fibers or fiber bundles loosen from each other resulting in good mixing of chemicals within the fiber suspension. When gas is introduced to this type of a mixing space, foam is produced.

Table 1 presents the water and gas amounts used when ozone bleaching is performed at the consistency of 10%.

When the consistency is 10% the pulp suspension contains one ton of fibers and nine tons of water. Approx. two tons of the water is absorbed in the walls of the fibers which leaves about seven tons of free water. The normal ozone dosage is around 1%, i.e. 10 kg $O_3$. The concentration of the ozone gas is 10% at the most, in other words the gas mixture contains 10 kg of $O_3$ and 90 kg of $O_2$ gas. As indicated in Table 1, the water/gas ratio varies between about 1/10 and about 1/1, depending on the pressure, which varies within the range of between 1 to about 10 atm.

TABLE 1

| | | | |
|---|---|---|---|
| 1 ton of fibers | | | |
| 2 tons of water in fibers | | | |
| 7 tons of free water | 7 $m^3$ | 7 $m^3$ | 7 $m^3$ |
| 1% $O_3$, 10 kg $O_3$, 90 kg $O_2$ | 70 $m^3$ | 14 $m^3$ | 7 $m^3$ |
| Pressure | 1 bar | 5 bar | 10 bar |
| Water/gas ratio | 1/10 | 1/2 | 1/1 |

The foam generated in a heavy-duty mixer is thus fairly light and the fiber material contained therein renders the foam relatively stable. There is a good transfer of substance between the gas and the fibers within the foam which results in good bleaching action even though the gas or the water cannot freely move among the fibers.

Laboratory tests with a batch-type fluidizing mixer. show that large amounts of gas are brought into the pulp suspensions. The tests were performed so that the gas and the pulp suspension were intensively mixed for a short time (approx. 1 second) and then the bleaching reaction was allowed to take place without further intensive mixing.

The gas had, however, a tendency to separate, and therefore a better bleaching result in the laboratory batch mixer was achieved when the gaseous chemicals were first intensively mixed into the fiber suspension in a fluidized state and the resulting gas-water-fiber foam or mixture was thereafter lightly agitated in order to prevent the separation of gas.

Figure 2:
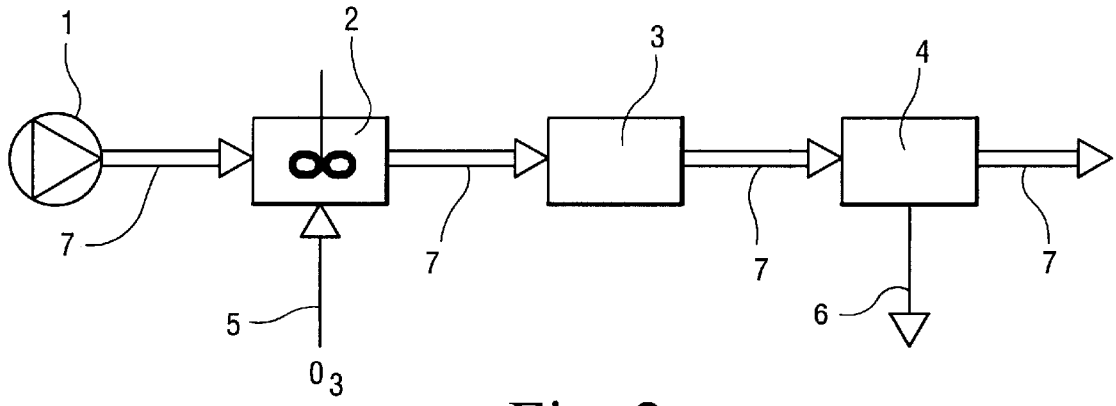
FIG. 2 illustrates a method according to a preferred embodiment for carrying out the ozone bleaching process of the invention.

FIG. 2 illustrates one way of carrying out the ozone bleaching process of the present invention. Pulp 7 is pumped wish a high-consistency pump 1 to an intensive mixer 2 into which ozone gas 5 is introduced. From the mixer, the pulp 7 is transferred to a reaction vessel 3 and from there to gas separation 4. After the reaction, residual gas 6, which is mainly the oxygen added to the pulp with the ozone 5, must be separated from the pulp. From the gas separation 4 the pulp flows on for further treatment. It is sometimes advisable to arrange for light agitation in the reaction vessel 3 to prevent the foam or mixture formed in the mixer 2 from collapsing. The agitation can suitably be accomplished by an agitator or by arranging proper flow conditions in the vessel 3.

Figure 3:
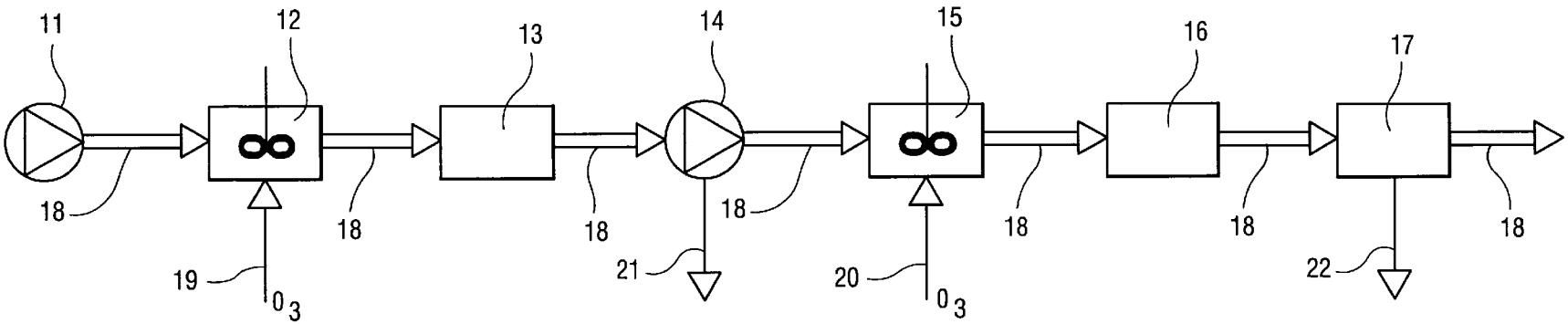
FIG. 3 illustrates another preferred embodiment of the ozone bleaching process of the present invention.

FIG. 3 schematically illustrates an alternative ozone bleaching process with several ozone feed stages. The amount of the ozone to be introduced to the process may be so large that it is not advantageous to add all the gas at the same time. In this case the method illustrated in FIG. 3 may be employed. Pulp 18 is pumped with a high-consistency pump 11 (preferably a fluidizing centrifugal pump made by A. Ahlstrom Corporation) to a mixer 12 into which ozone 19 is introduced. Pulp 18 flows via reaction vessel 13 to a gas-removing high-consistency pump 14 (preferably a fluidizing, gas-separating centrifugal pump made by A. Ahlstrom Corporation). Residual gas 21 is removed. From the high-consistency pump 14 the pulp flows to a second mixer 15, into which ozone 20 is introduced. After reaction vessel 16 and gas removal step 17 the pulp flows on to a further treatment stage. Again the reaction vessels 13 and 16 may be equipped with some kind of agitation device known in the art.

It is clear that more than two bleaching stages can be utilized in the corresponding manner as described. The stages can be pressurized, pressureless or the process can be performed at underpressure. The density of the produced foam can be regulated by choosing an appropriate pressure.

Pilot tests were performed according to the apparatus and further shown in FIG. 2. For practical reasons normal air was used without addition of ozone gas. The goal of the instant tests was to study the mixing behavior and action of large amounts of gas into fiber suspensions. The reaction vessel 13 was partly replaced by a plexiglass pipe where the formed foam or mixture could be inspected. The foam or mixture varied considerably depending on the surface tension of the water suspension, the type of fiber, and the amount of gas. In some tests the foam or mixture looked much like a snowstorm wherein bundles of fibers flew in the gas like snow flakes in air. However, water drops and free single fibers were also present in the gas. It became apparent that high mixing intensity is needed to form a foam or mixture like this from the original somewhat solid fiber suspension having a consistency of about 10%. It is also clear that some light agitation or special fluid conditions are preferably needed to prevent the foam or mixture from collapsing. Other tests with soap added to reduce surface tension produced more milk-like foams.

The residual gas 6, 21, 22 produced by the reaction can be utilized in many ways. The typical ozone gas contains 9 parts oxygen per each part ozone. The residual gas is thus mainly, oxygen and because of its lower reactivity, does not have enough time to react. The residual oxygen gas can be used in any other stage of the pulp production process, for example as additional chemical elsewhere in the bleaching plant or as combustion gas e.g. in a soda recovery boiler or in a lime sludge reburning kiln.

EXAMPLE 1

In the laboratory, pulp was bleached in the sequence OZDED instead of the conventional OCEDED (O=oxygen, Z=ozone, D=chlorine dioxide, E=alkaline extraction). At all bleaching stages the fiber suspension had a consistency of 10%. The goal was to verify that Z can replace CE and that the Z stage can be performed at the consistency of 10%.

With an ozone dosage of about 0.9%, the kappa number after the oxygen stage could be reduced to 8–9 in the ozone stage without damaging the fibers. With a conventional CE stage, the kappa number is reduced to about 5–6 or somewhat lower than in the Z stage. However, the reduction in the Z stage is large enough to enable final bleaching with DED. It is thus possible to completely replace the chlorine with ozone by using the medium consistency (10%) ozone bleaching of the present invention. This is a significant improvement as the severe environmental problems connected with the use of chlorine are thus avoided.

The ozone stage performed at the consistency of 10% was also compared with ozone stages performed at the consistencies of 1% and 30%. It was apparent that ozone bleaching performed at the consistencies of 1% and 10% gave approximately the same result. This is probably due to the good mass transfer occurring in a very dilute agitated solution and in a foam-type mixture. The bleaching performed at the consistency of 30% gave somewhat less beneficial results. This is probably due to the fact that in a pulp of the consistency of 30%, there are always present rather large size flakes of fibers, into the inside of which the ozone cannot penetrate properly, with the result that the surface of the flakes becomes overbleached while the inside remains largely unbleached.

EXAMPLE 2

A mill feasibility study was performed to evaluate the size of the machinery needed for ozone bleaching in accordance with the present invention at consistencies of 1%, 10%, and 30%.

At 1%, a reaction vessel provided with agitation device and operating at 1% fiber-water suspension was needed into which oxygen-ozone gas was added. A residual gas collecting system was needed as well as a filter machine which after the bleaching raised the consistency to 10–15% before the next process step.

At 10%, only one mixer with high shearing capacity was needed, and a small reaction vessel with light agitation created by an agitator or by flow conditions. No filter was needed and only a small gas separator before the next process step.

At 30% consistency, a press was needed before the reaction tower to raise the consistency. Additionally, a high-consistency mixer was needed, and a reaction tower capable of handling solid-gas reactions and provided with intermediate bottoms. After the reaction tower, a dilution, gas separation and discharge system was needed.

From the preceding it appeared that the machinery needed for bleaching pulp at a consistency of 10% was by far the cheapest and simplest.

As can be gleaned from the above description, a novel method of avoiding the disadvantages of the prior art ozone bleaching processes has been described. The two preferred applications of the method described above are in no way intended to limit the present invention which is claimed in the appended patent claims which alone define the scope of protection and coverage of the present invention. Thus, although only a few bleaching agents have been mentioned in the above examples, the other bleaching stages may use any suitable bleaching agent, e.g. chlorine, ozone, peroxid, chlorine dioxide, sodium hydroxide or enzymes.

What is claimed is:

1. A method of bleaching cellulose pulp having a consistency between 5–25% in a stage wherein ozone is the only bleaching agent in the stage, comprising the steps of:

(a) introducing the pulp with a consistency between 5–25% into a fluidizing mixer;

(b) introducing a mixture of ozone, serving as the only bleaching agent in the stage, and oxygen gas into the fluidizing mixer;

(c) intensely mixing the pulp and the gas in the fluidizing mixer for approximately one second so as to form a foam, the ozone, as the only bleaching agent in the stage, reacting with the pulp while in foam configuration to effect bleaching; and (d) removing residual gas from the pulp after the reaction in step (c).

2. A method as recited in claim 1 wherein the pulp has a consistency of between about 10–15% throughout the practice of steps (a) through (d).

3. A method as recited in claim 2 wherein steps (a) through (c) are practiced at superatmospheric pressure.

4. A method as recited in claim 3 wherein steps (a) through (c) are practiced at a pressure of at least 5 bar.

5. A method as recited in claim 4 comprising the further step, after (d), of performing a second bleaching operation in the stage by mixing the pulp from step (d) and ozone, serving as the only bleaching agent and oxygen gas in a second fluidizing mixture to produce a second foam like mixture.

6. A method as recited in claim 4 comprising the further step (e), between steps (c) and (d), of maintaining the foam like nature of the mixture under superatmospheric pressure until the ozone has had sufficient time to substantially completely react with the pulp.

7. A method as recited in claim 3 wherein steps (a) through (c) are practiced at a pressure of about 5–10 bar.

8. A method as recited in claim 7 comprising the further step, after (d), of performing a second bleaching operation in the stage by mixing the pulp from step (d) and ozone, serving as the only bleaching agent, and oxygen gas in a second fluidizing mixture to produce a second foam like mixture.

9. A method as recited in claim 7 comprising the further step (e), between steps (c) and (d), of maintaining the foam like nature of the mixture under superatmospheric pressure until the ozone has had sufficient time to substantially completely react with the pulp.

10. A method as recited in claim 3 comprising the further step, after (d), of performing a second bleaching operation in the stage by mixing the pulp from step (d) and ozone, serving as the only bleaching agent, and oxygen gas in a second fluidizing mixture to produce a second foam like mixture.

11. A method as recited in claim 10 comprising the further step (f), between steps (c) and (d), of maintaining the foam like nature of the mixture under superatmospheric pressure until the ozone has had sufficient time to substantially completely react with the pulp.

12. A method as recited in claim 3 comprising the further step (e), between steps (c) and (d), of maintaining the foam like nature of the mixture under superatmospheric pressure until the ozone has had sufficient time to substantially completely react with the pulp.

13. A method as recited in claim 1 wherein steps (a) through (c) are practiced at superatmospheric pressure.

14. A method as recited in claim 1 wherein steps (a) through (c) are practiced at a pressure of at least 5 bar.

15. A method as recited in claim 1 wherein steps (a) through (c) are practiced at a pressure of about 5–10 bar.

16. A method as recited in claim 1 comprising the further step, after (d), of performing a second bleaching operation in the stage by mixing the pulp from step (d) and ozone, serving as the only bleaching agent and oxygen gas in a second fluidizing mixture to produce a second foam like mixture.

17. A method as recited in claim 1 comprising the further step (e), between steps (c) and (d), of maintaining the foam like nature of the mixture under superatmospheric pressure until the ozone has had sufficient time to substantially completely react with the pulp.

18. A method as recited in claim 1 wherein step (b) is practiced with a gas-free liquid volume ratio of 2:1 to 1:1.

* * * * *